US008245478B2

(12) United States Patent
Bergelin et al.

(10) Patent No.: US 8,245,478 B2
(45) Date of Patent: Aug. 21, 2012

(54) SET OF FLOORBOARDS WITH SEALING ARRANGEMENT

(75) Inventors: Marcus Bergelin, Lerberget (SE); Mats Nilsson, Helsingborg (SE)

(73) Assignee: Välinge Innovation AB, Viken (SE)

( * ) Notice: Subject to any disclaimer, the term of this patent is extended or adjusted under 35 U.S.C. 154(b) by 0 days.

(21) Appl. No.: 13/046,011

(22) Filed: Mar. 11, 2011

(65) Prior Publication Data

US 2011/0154763 A1 Jun. 30, 2011

Related U.S. Application Data

(63) Continuation of application No. 11/649,837, filed on Jan. 5, 2007, now Pat. No. 7,930,862.

(60) Provisional application No. 60/758,213, filed on Jan. 12, 2006.

(30) Foreign Application Priority Data

Jan. 12, 2006 (SE) ..... 0600055

(51) Int. Cl.
*E04F 15/16* (2006.01)
*E04F 15/04* (2006.01)

(52) U.S. Cl. ..... 52/592.1; 52/588.1; 428/50; 428/192

(58) Field of Classification Search ..... 52/177, 52/311.1, 314, 316, 578, 506.01, 592.1, 591.3, 52/588.1; 428/50
See application file for complete search history.

(56) References Cited

U.S. PATENT DOCUMENTS

| | | | |
|---|---|---|---|
| 124,228 | A | 3/1872 | Stuart |
| 213,740 | A | 4/1879 | Connor |
| 1,194,636 | A | 8/1916 | Joy |
| 1,371,856 | A | 3/1921 | Cade |
| 1,723,306 | A | 8/1929 | Sipe |
| 1,743,492 | A | 1/1930 | Sipe |
| 1,787,027 | A | 12/1930 | Wasleff |
| 1,809,393 | A | 6/1931 | Rockwell |
| 1,898,364 | A | 2/1933 | Gynn |
| 1,902,716 | A | 3/1933 | Newton |
| 1,925,070 | A | 8/1933 | Livezey |
| 2,026,511 | A | 5/1934 | Storm |
| 2,015,813 | A | 10/1935 | Nielsen |
| 2,088,238 | A | 7/1937 | Greenway |
| 2,089,075 | A | 8/1937 | Siebs |
| 2,204,675 | A | 6/1940 | Grunert |
| 2,266,464 | A | 12/1941 | Kraft |
| 2,269,926 | A | 1/1942 | Crooks |
| 2,277,758 | A | 3/1942 | Hawkins |
| 2,303,745 | A | 12/1942 | Karreman |

(Continued)

FOREIGN PATENT DOCUMENTS

| | | |
|---|---|---|
| CA | 991373 | 6/1976 |

(Continued)

OTHER PUBLICATIONS

Pervan, Darko, U.S. Appl. No. 12/977,399, entitled "Mechanical Locking System for Floor Panels," filed in the U. S. Patent and Trademark Office on Dec. 23, 2010.

(Continued)

*Primary Examiner* — Robert J Canfield
(74) *Attorney, Agent, or Firm* — Buchanan, Ingersoll & Rooney PC

(57) ABSTRACT

A set of moisture proof floorboards and a flooring of such floorboards with a resilient surface layer provided with a sealing means.

21 Claims, 6 Drawing Sheets

U.S. PATENT DOCUMENTS

| | | | |
|---|---|---|---|
| 2,306,295 | A | 12/1942 | Casto |
| 2,430,200 | A | 11/1947 | Wilson |
| 2,497,837 | A | 2/1950 | Nelson |
| 2,596,280 | A | 5/1952 | Nystrom |
| 2,732,706 | A | 1/1956 | Friedman |
| 2,740,167 | A | 4/1956 | Rowley |
| 2,805,852 | A | 9/1957 | Malm |
| 2,863,185 | A | 12/1958 | Riedi |
| 2,865,058 | A | 12/1958 | Andersson et al. |
| 2,872,712 | A | 2/1959 | Brown et al. |
| 2,889,016 | A | 6/1959 | Warren |
| 2,947,040 | A | 8/1960 | Schultz |
| 3,023,681 | A | 3/1962 | Worson |
| 3,200,553 | A | 8/1965 | Frashour |
| 3,204,380 | A | 9/1965 | Wilson et al. |
| 3,259,417 | A | 7/1966 | Chapman |
| 3,271,787 | A | 9/1966 | Clary |
| 3,347,048 | A | 10/1967 | Brown |
| 3,378,958 | A | 4/1968 | Parks et al. |
| 3,387,422 | A | 6/1968 | Wanzer |
| 3,396,640 | A | 8/1968 | Fujihara |
| 3,436,888 | A | 4/1969 | Ottosson |
| 3,440,790 | A | 4/1969 | Nerem |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,538,665 | A | 11/1970 | Gohner |
| 3,554,850 | A | 1/1971 | Kuhle |
| 3,572,224 | A | 3/1971 | Perry |
| 3,579,941 | A | 5/1971 | Tibbals |
| 3,694,983 | A | 10/1972 | Couquet |
| 3,720,027 | A | 3/1973 | Christensen |
| 3,722,379 | A | 3/1973 | Koester |
| 3,731,445 | A | 5/1973 | Hoffmann et al. |
| 3,742,669 | A | 7/1973 | Mansfeld |
| 3,760,547 | A | 9/1973 | Brenneman |
| 3,760,548 | A | 9/1973 | Sauer |
| 3,778,954 | A | 12/1973 | Meserole |
| 3,849,235 | A | 11/1974 | Gwynne |
| 3,859,000 | A | 1/1975 | Webster |
| 3,919,820 | A | 11/1975 | Green |
| 3,950,915 | A | 4/1976 | Cole |
| 4,007,994 | A | 2/1977 | Brown |
| 4,030,852 | A | 6/1977 | Hein |
| 4,037,377 | A | 7/1977 | Howell et al. |
| 4,064,571 | A | 12/1977 | Phipps |
| 4,080,086 | A | 3/1978 | Watson |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. et al. |
| 4,169,688 | A | 10/1979 | Toshio |
| RE30,233 | E | 3/1980 | Lane et al. |
| 4,196,554 | A | 4/1980 | Anderson et al. |
| 4,227,430 | A | 10/1980 | Jansson |
| 4,242,390 | A | 12/1980 | Nemeth |
| 4,299,070 | A | 11/1981 | Oltmanns |
| 4,304,083 | A | 12/1981 | Anderson |
| 4,426,820 | A | 1/1984 | Terbrack |
| 4,471,012 | A | 9/1984 | Maxwell |
| 4,512,131 | A | 4/1985 | Laramore |
| 4,574,099 | A | 3/1986 | Nixon |
| 4,599,841 | A | 7/1986 | Haid |
| 4,648,165 | A | 3/1987 | Whitehorne |
| 4,716,700 | A | 1/1988 | Hagemeyer |
| 4,807,412 | A | 2/1989 | Frederiksen |
| 4,819,932 | A | 4/1989 | Trotter, Jr. |
| 4,944,514 | A | 7/1990 | Suiter |
| 5,071,282 | A | 12/1991 | Brown |
| 5,134,026 | A | 7/1992 | Melcher |
| 5,135,597 | A | 8/1992 | Barker |
| 5,148,850 | A | 9/1992 | Urbanick |
| 5,173,012 | A | 12/1992 | Ortwein et al. |
| 5,182,892 | A | 2/1993 | Chase |
| 5,216,861 | A | 6/1993 | Meyerson |
| 5,247,773 | A | 9/1993 | Weir |
| 5,253,464 | A | 10/1993 | Nilsen |
| 5,274,979 | A | 1/1994 | Tsai |
| 5,295,341 | A | 3/1994 | Kajiwara |
| 5,333,429 | A | 8/1994 | Cretti |
| 5,344,700 | A | 9/1994 | McGath et al. |
| 5,348,778 | A | 9/1994 | Knipp et al. |
| 5,349,796 | A | 9/1994 | Meyerson |
| 5,433,806 | A | 7/1995 | Pasquali et al. |
| 5,465,546 | A | 11/1995 | Buse |
| 5,497,589 | A | 3/1996 | Porter |
| 5,502,939 | A | 4/1996 | Zadok et al. |
| 5,540,025 | A | 7/1996 | Takehara et al. |
| 5,548,937 | A | 8/1996 | Shimonohara |
| 5,577,357 | A | 11/1996 | Civelli |
| 5,587,218 | A | 12/1996 | Betz |
| 5,598,682 | A | 2/1997 | Haughian |
| 5,618,602 | A | 4/1997 | Nelson |
| 5,634,309 | A | 6/1997 | Polen |
| 5,671,575 | A | 9/1997 | Wu |
| 5,694,730 | A | 12/1997 | Del Rincon |
| 5,695,875 | A | 12/1997 | Larsson |
| 5,706,621 | A | 1/1998 | Pervan |
| 5,755,068 | A | 5/1998 | Ormiston |
| 5,797,237 | A | 8/1998 | Finkell, Jr. |
| 5,858,160 | A | 1/1999 | Piacente |
| 5,860,267 | A | 1/1999 | Pervan |
| 5,899,038 | A | 5/1999 | Stroppiana |
| 5,900,099 | A | 5/1999 | Sweet |
| 5,950,389 | A | 9/1999 | Porter |
| 6,006,486 | A | 12/1999 | Moriau et al. |
| 6,029,416 | A | 2/2000 | Andersson |
| 6,052,960 | A | 4/2000 | Yonemura |
| 6,101,778 | A | 8/2000 | Mortensson |
| 6,115,926 | A | 9/2000 | Robell |
| 6,139,945 | A | 10/2000 | Krejchi et al. |
| 6,146,252 | A | 11/2000 | Martensson |
| 6,173,548 | B1 | 1/2001 | Hamar et al. |
| 6,182,410 | B1 | 2/2001 | Pervan |
| 6,203,653 | B1 | 3/2001 | Seidner |
| 6,209,278 | B1 | 4/2001 | Tychsen |
| 6,216,409 | B1 | 4/2001 | Roy et al. |
| 6,233,899 | B1 | 5/2001 | Mellert |
| 6,254,301 | B1 | 7/2001 | Hatch |
| 6,295,779 | B1 | 10/2001 | Canfield |
| 6,314,701 | B1 | 11/2001 | Meyerson |
| 6,324,809 | B1 | 12/2001 | Nelson |
| 6,332,733 | B1 | 12/2001 | Hamberger et al. |
| 6,345,481 | B1 | 2/2002 | Nelson |
| 6,358,352 | B1 | 3/2002 | Schmidt |
| 6,363,677 | B1 | 4/2002 | Chen et al. |
| 6,374,880 | B2 | 4/2002 | Macpherson et al. |
| 6,385,936 | B1 | 5/2002 | Schneider |
| 6,401,415 | B1 | 6/2002 | Garcia |
| 6,418,683 | B1 | 7/2002 | Martensson et al. |
| 6,438,919 | B1 | 8/2002 | Knauseder |
| 6,446,413 | B1 | 9/2002 | Gruber |
| 6,450,235 | B1 | 9/2002 | Lee et al. |
| 6,490,836 | B1 | 12/2002 | Moriau |
| 6,505,452 | B1 | 1/2003 | Hannig et al. |
| 6,536,178 | B1 | 3/2003 | Pålsson |
| 6,546,691 | B2 | 4/2003 | Leopolder |
| 6,553,724 | B1 | 4/2003 | Bigler |
| 6,576,079 | B1 | 6/2003 | Kai |
| 6,591,568 | B1 | 7/2003 | Palsson |
| 6,601,359 | B2 | 8/2003 | Olofsson |
| 6,617,009 | B1 | 9/2003 | Chen et al. |
| 6,647,689 | B2 | 11/2003 | Heitzinger et al. |
| 6,647,690 | B1 | 11/2003 | Martensson |
| 6,651,400 | B1 | 11/2003 | Murphy |
| 6,672,030 | B2 | 1/2004 | Schulte |
| 6,679,011 | B2 | 1/2004 | Beck et al. |
| 6,695,944 | B2 | 2/2004 | Courtney |
| 6,711,869 | B2 | 3/2004 | Tychsen |
| 6,729,091 | B1 | 5/2004 | Martensson |
| 6,763,643 | B1 | 7/2004 | Martensson |
| 6,766,622 | B1 | 7/2004 | Thiers |
| 6,769,218 | B2 | 8/2004 | Pervan |
| 6,769,219 | B2 | 8/2004 | Schwitte et al. |
| 6,786,019 | B2 | 9/2004 | Thiers |
| 6,802,166 | B1 | 10/2004 | Duernberger |

6,804,926 B1 10/2004 Eisermann
6,851,237 B2 2/2005 Niese et al.
6,854,235 B2 2/2005 Martensson
6,874,291 B1 4/2005 Weber
6,880,305 B2 4/2005 Pervan et al.
6,880,307 B2 4/2005 Schwitte et al.
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,948,716 B2 9/2005 Drouin
6,955,020 B2 10/2005 Moriau et al.
6,966,963 B2 11/2005 O'Connor
7,021,019 B2 4/2006 Knauseder
7,040,068 B2 5/2006 Moriau et al.
7,047,697 B1 5/2006 Heath
7,051,486 B2 5/2006 Pervan
7,055,290 B2 6/2006 Thiers
7,086,205 B2 8/2006 Pervan
D528,671 S 9/2006 Grafenauer
7,121,058 B2 10/2006 Palsson et al.
7,127,860 B2 10/2006 Pervan et al.
7,131,242 B2 11/2006 Martensson et al.
7,137,229 B2 11/2006 Pervan
7,152,383 B1 12/2006 Wilkinson et al.
7,171,791 B2 2/2007 Pervan
7,219,392 B2 5/2007 Mullet et al.
7,251,916 B2 8/2007 Konzelmann et al.
7,275,350 B2 10/2007 Pervan
7,328,536 B2 2/2008 Moriau et al.
7,356,971 B2 4/2008 Pervan
7,377,081 B2 5/2008 Ruhdorfer
7,386,963 B2 6/2008 Pervan
7,398,625 B2 7/2008 Pervan
7,441,384 B2 10/2008 Miller et al.
7,441,385 B2 10/2008 Palsson et al.
7,454,875 B2 11/2008 Pervan et al.
7,484,338 B2 2/2009 Pervan et al.
7,516,588 B2 4/2009 Pervan
7,533,500 B2 5/2009 Morton et al.
7,556,849 B2 7/2009 Thompson et al.
7,568,322 B2 8/2009 Pervan
7,584,583 B2 9/2009 Bergelin et al.
7,596,920 B2 10/2009 Konstanczak
7,603,826 B1 10/2009 Moebus
7,614,197 B2 11/2009 Nelson
7,617,651 B2 11/2009 Grafenauer
7,621,092 B2 11/2009 Groeke et al.
7,632,561 B2 12/2009 Thiers
7,634,884 B2 12/2009 Pervan et al.
7,637,068 B2 12/2009 Pervan
7,677,005 B2 3/2010 Pervan
7,721,503 B2 5/2010 Pervan et al.
7,739,849 B2 6/2010 Pervan
7,757,452 B2 7/2010 Pervan
7,802,411 B2 9/2010 Pervan
7,802,415 B2 9/2010 Pervan et al.
7,806,624 B2 10/2010 McLean et al.
7,841,144 B2 11/2010 Pervan
7,841,145 B2 11/2010 Pervan
7,841,150 B2 11/2010 Pervan
7,861,482 B2 1/2011 Pervan et al.
7,866,110 B2 1/2011 Pervan
7,866,115 B2 1/2011 Pervan et al.
7,874,119 B2 1/2011 Pervan
7,886,497 B2 2/2011 Pervan
7,908,815 B2 3/2011 Pervan et al.
7,926,234 B2 4/2011 Pervan et al.
7,930,862 B2 4/2011 Bergelin et al.
8,021,741 B2 9/2011 Chen
2002/0007608 A1 1/2002 Pervan
2002/0007609 A1 1/2002 Pervan
2002/0031646 A1 3/2002 Chen et al.
2002/0046433 A1 4/2002 Sellman, Jr. et al.
2002/0056245 A1 5/2002 Thiers
2002/0083673 A1 7/2002 Kettler et al.
2002/0092263 A1 7/2002 Schulte
2002/0095894 A1 7/2002 Pervan
2002/0100231 A1 8/2002 Miller et al.
2002/0112429 A1 8/2002 Niese et al.
2002/0112433 A1 8/2002 Pervan
2002/0170257 A1 11/2002 McLain et al.
2002/0170259 A1 11/2002 Ferris
2002/0178674 A1 12/2002 Pervan
2002/0178680 A1 12/2002 Martensson
2002/0178681 A1 12/2002 Zancai
2002/0189183 A1 12/2002 Ricciardelli
2003/0009971 A1 1/2003 Palmberg
2003/0024199 A1 2/2003 Pervan et al.
2003/0024200 A1 2/2003 Moriau et al.
2003/0037504 A1 2/2003 Schwitte et al.
2003/0084636 A1 5/2003 Pervan
2003/0094230 A1 5/2003 Sjoberg
2003/0101674 A1 6/2003 Pervan et al.
2003/0101681 A1 6/2003 Tychsen
2003/0154676 A1 8/2003 Schwartz
2003/0180091 A1 9/2003 Stridsman
2003/0188504 A1 10/2003 Ralf
2003/0196397 A1 10/2003 Niese et al.
2003/0196405 A1 10/2003 Pervan
2004/0031227 A1 2/2004 Knauseder
2004/0035077 A1 2/2004 Martensson et al.
2004/0045254 A1 3/2004 Van der Heijden et al.
2004/0049999 A1 3/2004 Krieger
2004/0060255 A1 4/2004 Knauseder
2004/0068954 A1 4/2004 Martensson
2004/0107659 A1 6/2004 Glockl
2004/0123548 A1 7/2004 Gimpel et al.
2004/0128934 A1 7/2004 Hecht
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0211144 A1 10/2004 Stanchfield
2004/0255541 A1 12/2004 Thiers et al.
2004/0261348 A1 12/2004 Vulin
2005/0055943 A1 3/2005 Pervan
2005/0138881 A1 6/2005 Pervan
2005/0166502 A1 8/2005 Pervan
2005/0166514 A1 8/2005 Pervan
2005/0193677 A1 9/2005 Vogel
2005/0208255 A1 9/2005 Pervan
2005/0210810 A1 9/2005 Pervan
2005/0235593 A1 10/2005 Hecht
2005/0252130 A1 11/2005 Martensson
2005/0268570 A2 12/2005 Pervan
2006/0032168 A1 2/2006 Thiers et al.
2006/0070333 A1 4/2006 Pervan
2006/0075713 A1 4/2006 Pervan
2006/0099386 A1 5/2006 Smith
2006/0101769 A1 5/2006 Pervan et al.
2006/0144004 A1 7/2006 Nollet et al.
2006/0156666 A1 7/2006 Caufield
2006/0236642 A1 10/2006 Pervan
2006/0260254 A1 11/2006 Pervan
2006/0283127 A1 12/2006 Pervan
2007/0006543 A1 1/2007 Engström
2007/0011981 A1 1/2007 Eisermann
2007/0028547 A1 2/2007 Grafenauer et al.
2007/0108679 A1 5/2007 Grothaus
2007/0151189 A1 7/2007 Yang
2007/0175143 A1 8/2007 Pervan et al.
2007/0175144 A1 8/2007 Hakansson
2007/0175156 A1 8/2007 Pervan et al.
2007/0193178 A1 8/2007 Groeke et al.
2007/0209736 A1 9/2007 Deringor et al.
2008/0000180 A1 1/2008 Pervan
2008/0000182 A1 1/2008 Pervan
2008/0000187 A1 1/2008 Pervan
2008/0000188 A1 1/2008 Pervan
2008/0000189 A1 1/2008 Pervan
2008/0000190 A1 1/2008 Hakansson
2008/0000194 A1 1/2008 Pervan
2008/0000417 A1 1/2008 Pervan
2008/0005989 A1 1/2008 Pervan

| | | | |
|---|---|---|---|
| 2008/0005992 | A1 | 1/2008 | Pervan |
| 2008/0005997 | A1 | 1/2008 | Pervan |
| 2008/0005998 | A1 | 1/2008 | Pervan |
| 2008/0005999 | A1 | 1/2008 | Pervan |
| 2008/0008871 | A1 | 1/2008 | Pervan |
| 2008/0010931 | A1 | 1/2008 | Pervan |
| 2008/0028707 | A1 | 2/2008 | Pervan |
| 2008/0028713 | A1 | 2/2008 | Pervan et al. |
| 2008/0029490 | A1 | 2/2008 | Martin et al. |
| 2008/0034701 | A1 | 2/2008 | Pervan |
| 2008/0034708 | A1 | 2/2008 | Pervan |
| 2008/0041007 | A1 | 2/2008 | Pervan et al. |
| 2008/0041008 | A1 | 2/2008 | Pervan |
| 2008/0060308 | A1 | 3/2008 | Pervan |
| 2008/0066415 | A1 | 3/2008 | Pervan |
| 2008/0104921 | A1 | 5/2008 | Pervan |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0138560 | A1 | 6/2008 | Windomller |
| 2008/0216920 | A1 | 9/2008 | Pervan |
| 2008/0236088 | A1 | 10/2008 | Hannig |
| 2008/0241440 | A1 | 10/2008 | Bauer |
| 2008/0263975 | A1 | 10/2008 | Mead |
| 2008/0295432 | A1 | 12/2008 | Pervan et al. |
| 2009/0133353 | A1 | 5/2009 | Pervan et al. |
| 2009/0155612 | A1 | 6/2009 | Pervan et al. |
| 2009/0193748 | A1 | 8/2009 | Pervan et al. |
| 2010/0043333 | A1 | 2/2010 | Hannig |
| 2010/0170189 | A1 | 7/2010 | Schulte |
| 2010/0229491 | A1 | 9/2010 | Pervan |
| 2010/0300030 | A1 | 12/2010 | Pervan et al. |
| 2010/0300031 | A1 | 12/2010 | Pervan et al. |
| 2010/0319290 | A1 | 12/2010 | Pervan et al. |
| 2010/0319291 | A1 | 12/2010 | Pervan et al. |
| 2011/0030303 | A1 | 2/2011 | Pervan et al. |
| 2011/0041996 | A1 | 2/2011 | Pervan |
| 2011/0056167 | A1 | 3/2011 | Nilsson et al. |
| 2011/0072754 | A1 | 3/2011 | Pervan et al. |
| 2011/0088344 | A1 | 4/2011 | Pervan et al. |
| 2011/0088345 | A1 | 4/2011 | Pervan |
| 2011/0131901 | A1 | 6/2011 | Pervan |
| 2011/0203214 | A1 | 8/2011 | Pervan |
| 2011/0209430 | A1 | 9/2011 | Pervan |

FOREIGN PATENT DOCUMENTS

| | | | |
|---|---|---|---|
| CA | 2 252 791 | A1 | 5/1999 |
| CA | 2 252 791 | C | 5/1999 |
| CA | 2 363 184 | A1 | 7/2001 |
| CA | 2456513 | A1 | 2/2003 |
| CH | 690 242 | A5 | 6/2000 |
| CN | 2106197 | U | 6/1992 |
| CN | 1270263 | A | 10/2000 |
| CN | 1376230 | A | 10/2002 |
| DE | 1 212 275 | | 3/1966 |
| DE | 2 159 042 | A1 | 6/1973 |
| DE | 26 16 077 | A1 | 10/1977 |
| DE | 3 041 781 | A1 | 6/1982 |
| DE | 33 43 601 | A1 | 6/1985 |
| DE | 3 538 538 | A1 | 10/1985 |
| DE | 4 130 115 | A1 | 9/1991 |
| DE | 39 32 980 | A1 | 11/1991 |
| DE | 42 15 273 | A1 | 11/1993 |
| DE | 42 42 530 | A1 | 6/1994 |
| DE | 295 17 995 | U1 | 3/1996 |
| DE | 196 01 322 | A1 | 5/1997 |
| DE | 198 54 475 | A1 | 7/1999 |
| DE | 198 51 200 | C1 | 3/2000 |
| DE | 299 22 649 | U1 | 4/2000 |
| DE | 199 07 939 | C1 | 5/2000 |
| DE | 200 02 744 | U1 | 9/2000 |
| DE | 199 40 837 | A1 | 11/2000 |
| DE | 199 58 225 | A1 | 6/2001 |
| DE | 100 01 248 | A1 | 7/2001 |
| DE | 100 32 204 | C1 | 7/2001 |
| DE | 100 08 166 | A1 | 9/2001 |
| DE | 100 34 407 | C1 | 10/2001 |
| DE | 100 57 901 | A1 | 6/2002 |
| DE | 202 05 774 | U1 | 8/2002 |
| DE | 202 06 460 | U1 | 8/2002 |
| DE | 102 32 508 | C1 | 12/2003 |
| DE | 203 14 850 | U1 | 1/2004 |
| DE | 103 16 695 | A1 | 10/2004 |
| DE | 103 43 441 | B3 | 5/2005 |
| DE | 203 20 799 | U1 | 5/2005 |
| DE | 10 2004 055 951 | A1 | 7/2005 |
| DE | 198 54 475 | B4 | 6/2006 |
| EP | 0 013 852 | A1 | 8/1980 |
| EP | 0 665 347 | A1 | 8/1995 |
| EP | 0 849 416 | A2 | 6/1998 |
| EP | 0 903 451 | A2 | 3/1999 |
| EP | 0 903 451 | A3 | 3/1999 |
| EP | 0 974 713 | A1 | 1/2000 |
| EP | 1 045 083 | A1 | 10/2000 |
| EP | 1 045 083 | B1 | 10/2000 |
| EP | 1 048 423 | A2 | 11/2000 |
| EP | 1 120 515 | A1 | 8/2001 |
| EP | 1 146 182 | A2 | 10/2001 |
| EP | 1 165 906 | A1 | 1/2002 |
| EP | 1 262 609 | A1 | 12/2002 |
| EP | 1 308 577 | A2 | 5/2003 |
| EP | 1 357 239 | A2 | 10/2003 |
| EP | 1 357 239 | A3 | 10/2003 |
| EP | 1 420 125 | A2 | 5/2004 |
| EP | 1 650 375 | A1 | 4/2006 |
| EP | 1 650 375 | A8 | 4/2006 |
| EP | 1 650 375 | A8 | 9/2006 |
| FR | 1138595 | | 6/1957 |
| FR | 2 256 807 | | 8/1975 |
| FR | 2 810 060 | A1 | 12/2001 |
| GB | 240 629 | | 10/1925 |
| GB | 812671 | | 4/1959 |
| GB | 1 171 337 | | 11/1969 |
| GB | 1 430 423 | A | 3/1976 |
| GB | 2051916 | A | 1/1981 |
| GB | 2 117 813 | A | 10/1983 |
| GB | 2 243381 | A | 10/1991 |
| GB | 2 256 023 | A | 11/1992 |
| JP | 59-185346 | U | 12/1984 |
| JP | 1-178659 | A | 7/1989 |
| JP | 1-33702 | Y2 | 10/1989 |
| JP | 3-110258 | A | 5/1991 |
| JP | 3-169967 | A | 7/1991 |
| JP | 5-018028 | A | 1/1993 |
| JP | 5-96282 | U | 12/1993 |
| JP | 6-39840 | B2 | 5/1994 |
| JP | 6-146553 | A | 5/1994 |
| JP | 6-280376 | A | 10/1994 |
| JP | 6-288017 | A | 10/1994 |
| JP | 6-306961 | A | 11/1994 |
| JP | 6-320510 | A | 11/1994 |
| JP | 6-322848 | A | 11/1994 |
| JP | 7-26467 | U | 5/1995 |
| JP | 7-180333 | A | 7/1995 |
| JP | 7-300979 | A | 11/1995 |
| JP | 7-310426 | A | 11/1995 |
| JP | 8-086080 | A | 4/1996 |
| JP | 8-109734 | A | 4/1996 |
| JP | 9-053319 | A | 2/1997 |
| JP | 9-088315 | A | 3/1997 |
| JP | 10-219975 | A | 8/1998 |
| JP | 11-131771 | A | 5/1999 |
| JP | 2000-226932 | A | 8/2000 |
| JP | 2001-254503 | A | 9/2001 |
| JP | 2002-276139 | A | 9/2002 |
| KR | 1996-0005785 | | 7/1996 |
| KR | 2007/0000322 | A | 1/2007 |
| SE | 450 141 | B | 6/1987 |
| SE | 502 994 | C2 | 3/1996 |
| SE | 512 313 | C2 | 2/2000 |
| WO | WO 84/02155 | A1 | 6/1984 |
| WO | WO 93/13280 | A1 | 7/1993 |
| WO | WO 94/01628 | A2 | 1/1994 |
| WO | WO 94/26999 | A1 | 11/1994 |
| WO | WO 96/27721 | A1 | 9/1996 |
| WO | WO 97/19232 | A1 | 5/1997 |
| WO | WO 97/47834 | A1 | 12/1997 |
| WO | WO 98/38401 | A1 | 9/1998 |

| | | | |
|---|---|---|---|
| WO | WO 99/58254 | A1 | 11/1999 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/22225 | A1 | 4/2000 |
| WO | WO 00/47841 | A1 | 8/2000 |
| WO | WO 00/66856 | A1 | 11/2000 |
| WO | WO 01/02669 | A1 | 1/2001 |
| WO | WO 01/02670 | A1 | 1/2001 |
| WO | WO 01/02672 | A1 | 1/2001 |
| WO | WO 01/07729 | A1 | 2/2001 |
| WO | WO 01/51732 | A1 | 7/2001 |
| WO | WO 01/51733 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/96688 | A1 | 12/2001 |
| WO | WO 01/98604 | A1 | 12/2001 |
| WO | WO 02/055809 | A1 | 7/2002 |
| WO | WO 02/055810 | A1 | 7/2002 |
| WO | WO 02/060691 | A1 | 8/2002 |
| WO | WO 02/092342 | A1 | 11/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/020764 | A1 | 3/2004 |
| WO | WO 2004/053257 | A1 | 6/2004 |
| WO | WO 2004/053257 | A8 | 6/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/054599 | A1 | 6/2005 |
| WO | WO 2005/054600 | A1 | 6/2005 |
| WO | WO 2005/068747 | A1 | 7/2005 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/008824 | A1 | 1/2008 |
| WO | WO 2008/017281 | A1 | 2/2008 |

OTHER PUBLICATIONS

Pervan, Darko, et al., U.S. Appl. No. 13/020,456, entitled "Mechanical Locking System for Floor Panels," filed in the U.S. Patent and Trademark Office on Feb. 3, 2011.

Pervan, Darko, et al., U.S. Appl. No. 13/158,776, entitled "Mechanical Locking System for Floor Panels," filed in the U.S. Patent and Trademark Office on Jun. 13, 2011.

Pervan, Darko, et al., U.S. Appl. No. 13/146,731, entitled "Mechanical Lockings of Floor Panels and a Tongue Blank," filed in the U.S. Patent and Trademark Office on Jul. 28, 2011.

Pervan, Darko, et al., U.S. Appl. No. 13/195,297, entitled "Mechanical Locking of Floor Panels With a Flexible Bristle Tongue," filed in the U.S. Patent and Trademark Office on Aug. 1, 2011.

Pervan, Darko, et al., U.S. Appl. No. 13/011,398, entitled "Floor Panel With Sealing Means," filed in the U.S. Patent and Trademark Office on Jan. 21, 2011.

Pervan, Darko, et al., U.S. Appl. No. 13/045,631, entitled "Floorboards With Decorative Grooves," filed in the U.S. Patent and Trademark Office on Mar. 11, 2011.

International Search Report issued in PCT/SE2007/000007 (Published as WO 2007/081267 A1 ), Mar. 21, 2007, Swedish Patent Office, Stockholm, SE.

International Preliminary Report on Patentability issued in PCT/SE2007/000007 (Published as WO 2007/081267 A1), Mar. 14, 2008, IPEA/SE—Patent-och registreringsverket, Stockholm, SE.

Written Opinion issued in PCT/SE2007/000007 (Published as WO 2007/081267 A1), Mar. 21, 2007, ISA/SE Patent-och registreringsverket, Stockholm, SE.

*Plaintiff's First Amended Complaint and Counterclaim on Reply, Akzenta Paneele = Profile GmbH and W. Classen GmbH & Co. KG*v. *Shaw Industries Group, Inc. and Valinge Innovation AB and Darko Pervan*, United States District Court for the Eastern District of Texas, Marshall Division, Case No. 2:10-CV-16, dated Nov. 30, 2010, and attachments thereto.

European prosecution file history, European Patent No. 1863984 (Appln. No. 06700664), dated Oct. 5, 2006-Sep. 9, 2010.

Official Action issued by the Japanese Patent Office in JP Patent Application No. 2003-517390, Dec. 18, 2007, pp. 1-3; and English-language translation thereof.

Pervan Darko, U.S. Appl. No. 13/253,283, entitled "Mechanical Locking System for Floor Panels," filed in the U.S. Patent and Trademark Office on Oct. 5, 2011.

Pervan, Darko, et al., U.S. Appl. No. 13/232,467, entitled "Mechanical Locking for Panels and Method of Installing Same," filed in the U.S. Patent and Trademark Office on Sep. 14, 2011.

Pervan, Darko, et al., U.S. Appl. No. 13/329,019 entitled "Mechanical Locking of Panels," filed in the U. S. Patent and Trademark Office on Dec. 16, 2011.

**Pervan, Darko, U.S. Appl. No. 13/343,439, entitled "Floorboard and Method for Manufacturing Thereof," filed in the U. S. Patent and Trademark Office on Jan. 4, 2012.

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

Drawing Figure 25/6107 From Buetec GmbH dated Dec. 16, 1985.

SET OF FLOORBOARDS WITH SEALING ARRANGEMENT

CROSS REFERENCE TO RELATED APPLICATIONS

The present application is a continuation of U.S. application Ser. No. 11/649,837, filed on Jan. 5, 2007, now U.S. Pat. No. 7,930,862, claims the benefit of U.S. Provisional Application No. 60/758,213, filed on Jan. 12, 2006 and the benefit of Swedish Application No. 0600055-8, filed on Jan. 12, 2006. The entire contents of each of U.S. application Ser. No. 11/649,837, U.S. Provisional Application No. 60/758,213 and Swedish Application No. 0600055-8 are hereby incorporated herein by reference.

AREA OF INVENTION

Embodiments of the present invention relate to a set of moisture proof floorboards and flooring with a resilient surface layer comprising a decorative groove and/or a sealing means.

BACKGROUND OF INVENTION

Embodiments of the invention may concern a floorboard comprising a mechanical locking system, formed at least at two opposite edges and a resilient surface layer provided with a decorative groove. The following description of known techniques, problems of known systems and objects and features of embodiments of the invention will above all, as a non-restrictive example, be aimed as the field of the application. It should be emphasized that embodiments of the invention may be used in any floorboard and it could be combined with all types of known locking systems, for example, where the floorboards are intended to be joined using a mechanical locking system connecting the panels in the horizontal and vertical directions on at least two adjacent sides.

It is known that a floorboard with a resilient surface layer can be provided with a decorative joint portion, in the form of a bevel, for example as described in WO 03/012224.

OBJECTS AND SUMMARY

The floorboards with a resilient surface layer with a decorative joint portion known up to now have several disadvantages. It is only possible to provide the edge with a bevel, which is smaller than the thickness of the resilient surface layer. If the bevel is made larger, the bevel extends down to the moisture sensitive core. The resilient layer is normally thin, and therefore it is only possible to produce small bevels, which are barely visible. Another disadvantage is that both joined and adjacent edges of two floorboards have to be provided with the bevel, in order to look attractive and to increase the total width of the decorative joint portion. Known joints between two floorboards with a resilient surface layer also have the problem of penetration of moisture into the joint, which destroys the moisture sensitive core or sub-floor. The problem increases if the floorboards at the joint are provided with bevels, due to accumulating of dirt and moisture at the bottom of the V-shaped grove, formed by the two adjacent bevels, and a remaining thin barrier part of resilient material.

Embodiments of the present invention relate to a moisture proof flooring and a set of moisture proof floorboards with a resilient surface layer comprising a decorative groove, which provides for embodiments offering advantages. A useful area for the floorboards are public flooring, e.g., in stores, restaurants, ships, hotels, airports, or at home in rooms which are heavily exposed to dirt and therefore often cleaned by mopping. Another useful area is wet-rooms. "Moisture proof floorboard" means that the front face of the floorboard is provided with a moisture proof material and that connecting means and edges of the floorboard are configured to obtain a joint between the floorboard and another adjacent floorboard which is moisture proof.

According to a first aspect, embodiments of the invention provide a set of moisture proof floorboards, comprising a front face, a rear face, a core, connecting means arranged at least at two opposite edges for connecting the floorboard with a similar floorboard, a resilient surface layer at the front face, preferably of rubber or plastic. The resilient surface layer comprises a decorative groove at an edge of the floorboard. The bottom of the decorative groove is essentially flat and parallel to the front face.

An advantage of embodiments of the invention is that there is no limitation of the width of the decorative groove. Even a large decorative groove may be watertight and protect the core or the sub-floor. A second advantage is that only half the amount of edges has to be worked, since it is possible to replace two narrow grooves with one wide groove.

Preferably the edge with the decorative groove comprises, in the resilient layer, a sealing means configured to cooperate with another sealing means in the resilient layer at an edge of another adjacent floorboard, to obtain a sealing. In one embodiment, the sealing means comprises a horizontally extending protrusion and the other sealing means comprises a sideways open groove. In the most preferred embodiment one or both of the sealing means are also provided with a sealing agent.

In another preferred embodiment both of the sealing means comprise a sideways open groove provided with a sealing agent.

Preferably, the connecting means comprise a mechanical locking system formed at least at two opposite edges of the floorboard, which facilitates the joining of a similar floorboard. Mechanical locking systems joined by angling are for instance known from WO 94/26999, which is especially advantageous at the long sides of a rectangular floor, and another locking system especially advantageous at the short sides, particularly when combined with an angling locking system like the one described in WO 94/26999, are described in PCT/SE2005/001586, owner Välinge Innovation AB. Other shapes of floorboards are also possible. The above mentioned combination of locking systems makes it possible to join floorpanels by several methods preferably with a single action method, where the long edge is installed with angling and the short edge, which is provided with a flexible tongue, with vertical folding. This combination is also very easy to disassemble. Other mechanical locking systems are also known, and possible to use, including, for example, systems joined by Angling-Angling, Angling-Snapping or Snapping-Snapping. Floor-boards with a mechanical locking system are generally laid floating, i.e. without gluing, on an existing subfloor.

It is also possible to use a tongue and a groove joint, usually combined with gluing or nailing or other fastening means.

According to an embodiment of the first aspect the wood based core may be made of MDF or HDF, preferably of a thickness of 6-9 mm. The thickness of the resilient surface layer is preferably 1-3 mm.

According to an embodiment, the resilient surface layer comprises three layers, a transparent wear layer at the top, a decorative intermediate layer and reinforcement layer closest to the core. It is also possible to print a pattern directly at the rear side of the transparent wear layer or at the top of the reinforcement layer. Preferably, the decorative groove is only in the transparent layer and optionally colored, but it is also possible to extend the groove down to the decorative layer or the reinforcement layer. Different colors of the layers create a visual effect by extending the groove down to other layers and no coloring may be needed. Another embodiment is a resilient layer comprising only a transparent layer and a reinforcement layer of, for example, a colored plastic or a cork layer. An alternative is that the decorative layer is a wood veneer or a cork layer or that the resilient surface layer has two layers, a transparent wear layer and reinforcement layer of, for example, cork.

According to a second aspect, embodiments of the invention provide a set of moisture proof floorboards, comprising a front face a rear face, a core, connecting means arranged at least at two opposite edges for connecting the floorboard with a similar floorboard, a resilient surface layer at the front face, preferably of rubber or plastic. A moisture proof floorboard being provided at an edge and in the resilient layer with a sealing means configured to cooperate with a another sealing means in the resilient layer at an edge of another adjacent floorboard, to obtain a sealing.

Preferably the sealing means comprises a horizontally extending protrusion and the other sealing means comprises a sideways open groove. In the most preferred embodiment one or both of the sealing means are provided with a sealing agent.

In another preferred embodiment both of the sealing means comprise a sideways open groove provided with a sealing agent.

The sealing means and the sealing agent increase the resistance of moisture and water penetration into the joint and the core and the aim is to completely seal the joint.

According to a second object, embodiments of the invention provide for a flooring comprising at least two of the floorboards above in the first object, joined along adjacent edges, preferably mechanically.

In view of the above, an objective of embodiments of the invention is to solve or at least reduce the problems discussed above.

In particular, an objective of embodiments of this invention is to provide a flooring and floorboard comprising a resilient surface layer with a decorative groove in the resilient surface layer, wherein the groove is clearly visible. Further, the floorboard is moisture proof and preferably shows great acoustic properties.

All references to "a/an/the [element, device, component, means, step, etc]" are to be interpreted openly as referring to at least one instance of said element, device, component, means, step, etc., unless explicitly stated otherwise.

BRIEF DESCRIPTION OF DRAWINGS

FIGS. 5*a* and 5*c*-6*c* show joined floorboards according to embodiments of the second aspect of the invention.

DETAILED DESCRIPTION OF EMBODIMENTS

As represented in FIGS. 1*b*-4, the first aspect of the invention relates to a set of moisture proof floorboards and flooring, provided with a resilient surface layer with a decorative groove.

Figure 1A:
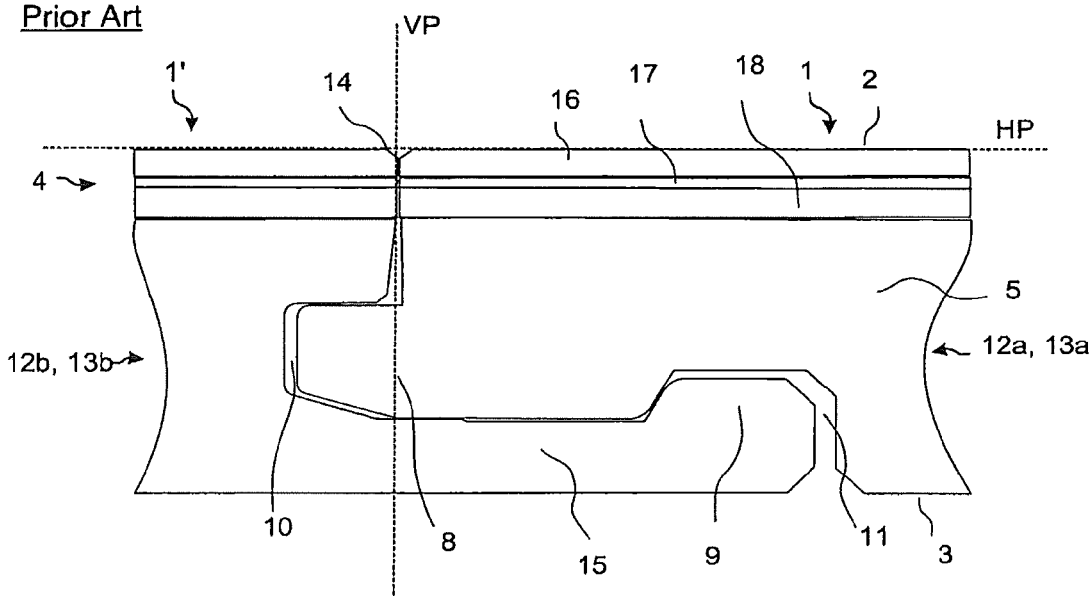
Fig. 1a Prior Art
FIG. 1*a* shows a floorboard with a resilient surface layer and decorative groove known in the art.
Figure 1B:
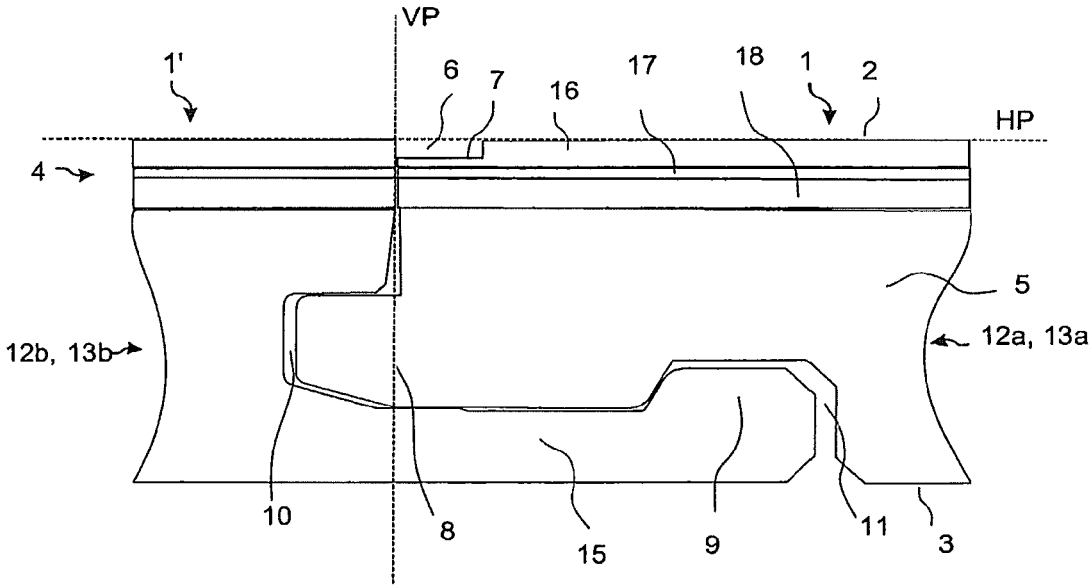
FIG. 1*b* shows a floorboard according to an embodiment of the invention.

FIG. 1*a* show floorboards with decorative joint portions known in the art and described in WO 03/012224. The floorboard 1 comprises a front face 2 and a rear face 3 extending in the direction of the horizontal plane HP, a wood-based core 5 and a resilient surface layer 4 at the front face. The resilient surface layer 4 comprises three different surface layers having different functions. The upper most layer is a transparent, hard and durable wear layer 16 of plastic material, the intermediate layer is a decorative layer 17 of plastic film and the lowest layer is a reinforcement layer 18 which is made of an elastic material and which can be both moisture-proof and sound-absorbing. The decorative layer 17 of plastic film can be replaced with decorative patterns, which are printed directly on the underside of the transparent wear layer 16 or on the upper side of the elastic reinforcement layer 18. The floorboard is provided with a mechanical locking system for locking the floorboards horizontally and vertically at its long and short edges (12*a*, 13*a*, 12*b*, 13*b*) through angling and/or snapping.

According to a first aspect of the invention, as represented in FIG. 1*b*-4*c*, a floorboard 1 is to be joined with a similar floorboard 1' at adjacent joint edges at a joint plane extending in the vertical plane VP, comprising a front face 2 and a rear face 3 extending in the horizontal plane HP, a core 5, a connecting means arranged at least at two opposite edges for connecting the floorboard with a similar floorboard 1' in a vertical and/or horizontal direction and a resilient surface layer 4, characterized in that at least one edge of the floorboard 1 comprising a decorative groove 6 in the resilient surface layer 4 with a bottom 7 which is essentially parallel to the front face 2. If the floorboard is rectangular, preferably only one of the long edges is provided with the decorative groove; certainly it is also possible to provide one of the long and one of the short edges with the groove 7. Other shapes of the board are also possible, e.g. 3, 5, 6, 7 and 8 edges. The resilient surface layer comprises preferably a transparent wear layer 16 at the top, preferably of a plastic material, an intermediate decorative layer 17 and an elastic reinforcement layer 18 closest to the core 5. The decorative layer 17, preferably of a plastic film can be replaced with decorative patterns, which are printed directly on the underside of the transparent wear layer 16 or on the upper side of the elastic reinforcement layer 18. An alternative is that the decorative layer is a wood veneer or cork layer. According to the embodiment represented in FIG. 1*b*, the groove 7 is only in the transparent layer and optionally the groove is colored.

Preferably the connecting means is a mechanical locking system formed at least at two opposite edges 12*a*, 13*a*, 12*b*, 13*b*. The shown mechanical locking system comprising a locking strip 15 with a locking element 9, a tongue 8 and a tongue groove 10. Other known mechanical locking systems for floorboards are also possible to use such as the tongue lock in FIG. 4*a-c* or the flexible tongue described in described in PCT/SE2005/001586. The tongue may also be replaced by a displaceable tongue 8' arranged in a displacement grove 54, as shown in FIGS. 5*b* to 6*c*, of the type disclosed in PCT/SE2005/001586 or PCT/SE2006/001218.

There are many alternatives for the number of layers in the resilient layer, the material of the layers and into which layer the groove extends. Some of the alternatives are represented in FIG. 1*b*-2*d*.

Figure 2A:
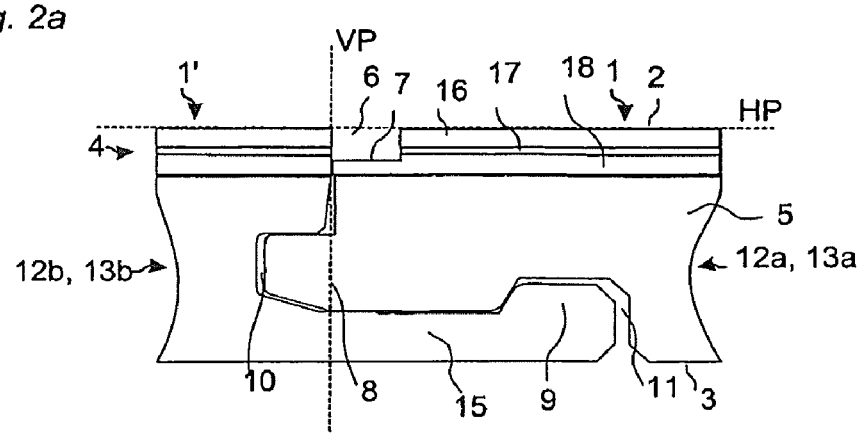
FIGS. 2*a-d* show alternative embodiments of the invention.

The resilient surface layer 4, illustrated in FIG. 2*a*, comprising a transparent surface layer 16, an intermediate decorative layer 17 and a reinforcement layer 18 closest to the core. The groove 6 extends down to the reinforcement layer and is preferably colored. If one of the layers in the resilient layer, represented in FIG. 1*b*-*bd* is of a non water proof or moisture sensitive material, it is preferred that the groove does not extend into this layer.

Figure 2B:
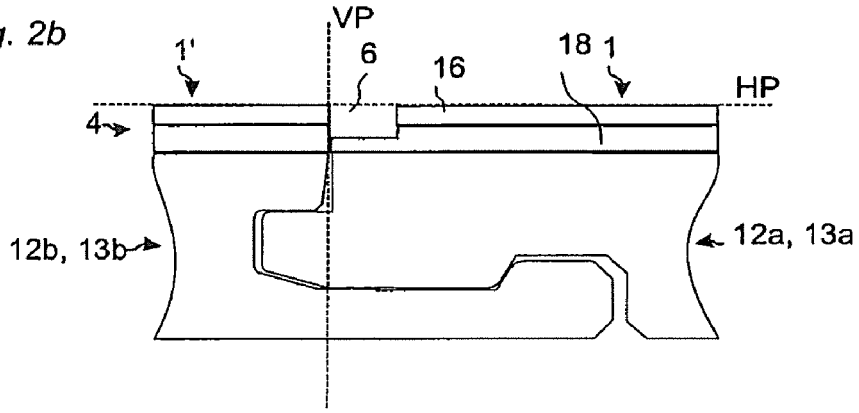

The resilient surface layer 4, illustrated in FIG. 2*b*, is substantially a transparent surface layer 16 and a reinforcement layer closest to the core 18. The groove 6 extends down to the reinforcement layer, preferably of plastic and is preferably colored.

Figure 2C:
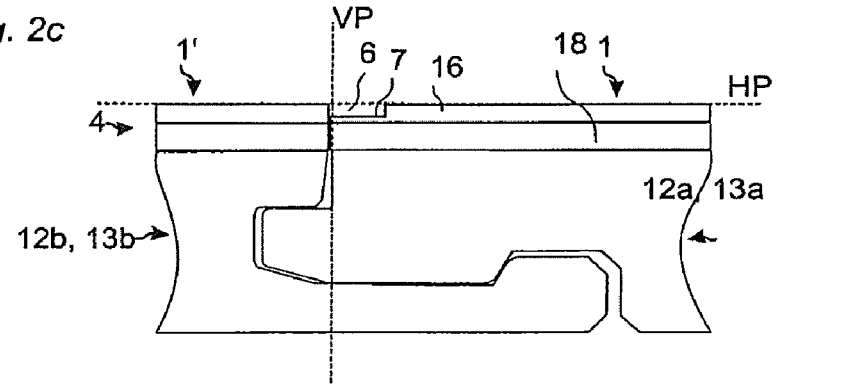

The resilient surface layer 4 illustrated in FIG. 2*c*, is substantially a transparent surface layer 16 and a reinforcement layer closest to the core 18. The groove 6 is only in the transparent layer and is preferably colored. The reinforcement layer is preferably of a colored plastic or a cork layer.

Figure 2D:
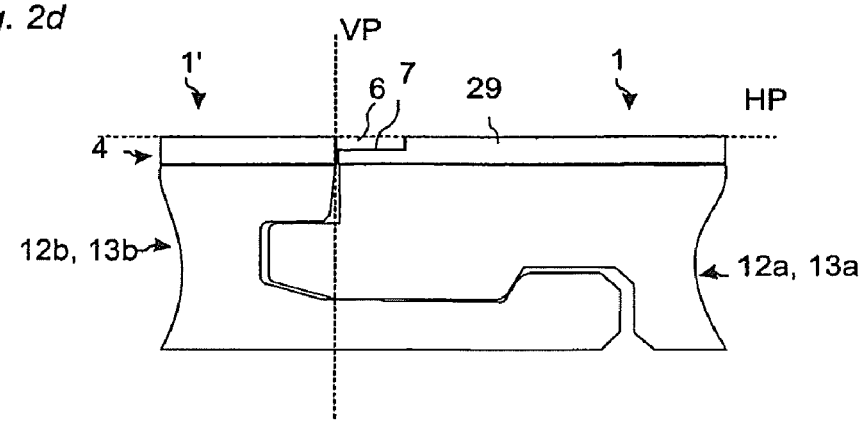

The resilient surface layer 4 in FIG. 2*d*, is substantially only one layer. The groove is preferably colored.

Figure 4A:
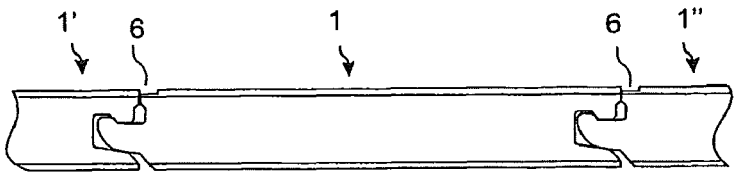
FIGS. 4*a-c* show a floorboard and joined floorboards in different views according to an embodiment of the invention.
Figure 4B:
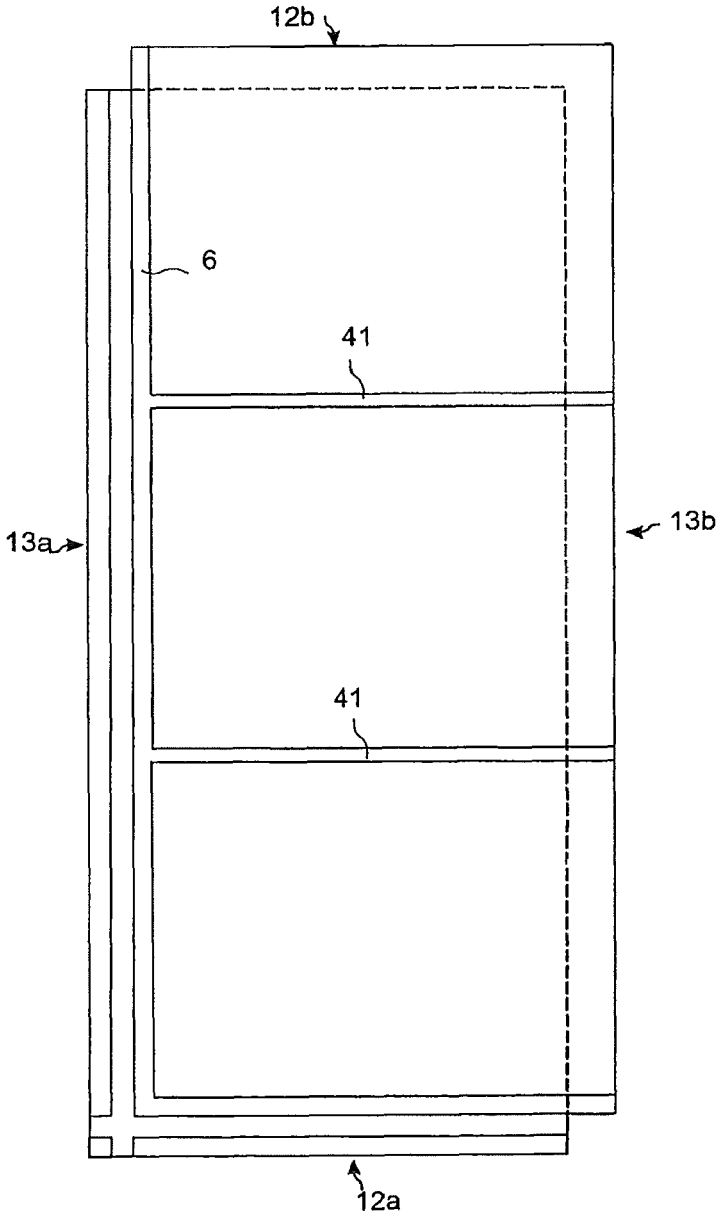
Figure 4C:
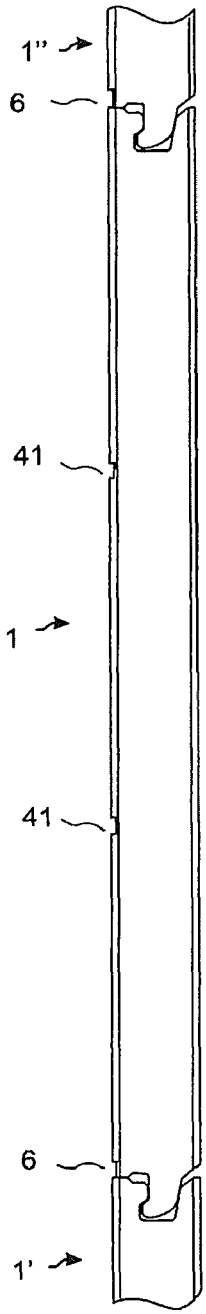

In FIG. 4*b* an embodiment of the invention is represented, comprising a rectangular floorboard 1 with a mechanical locking system at long 13*a*, 13*b* and short edges 12*a*, 12*b* and a decorative groove 6 along only one of the long edges and along only one of the short edges. Additional grooves 41 in the resilient surface layer, between the short edges, are provided. FIG. 4*a* is a cross section of the floorboard in FIG. 6*b*, perpendicular to the long edges, joined to similar floorboards 1' and 1". FIG. 4*c* is a cross section of the floorboard in FIG. 4*b*, perpendicular to the short edges, joined to similar floorboards 1' and 1".

The wood-based core material is preferably a particle, MDF, HDF or plywood board.

As non-limiting example, materials that can be used in a resilient surface layer are acrylic plastic-based materials, elastomers of synthetic rubber, urethane rubber, silicone rubber or the like, polyurethane-based hot-melt adhesive, PVC or polyethylene.

The decorative groove may be made by chemical or mechanical working, preferably cutting or grinding. It is also possible to color the groove. If grinding is used it is possible to make a very shallow groove or even just change the roughness and the brightness of the surface. The grinding method is applicable also to a laminate flooring with a surface layer of resin-impregnated sheets. Another technique is to cut off a part of the resilient surface layer, or cut it to the desirable shape before attaching it to the core, and replace it with another resilient layer of different color or structure.

A second aspect of the invention, as illustrated in FIG. 5*a*-6*c*, is a set of essentially identical moisture proof floorboards 1 each comprising a sealing means at an edge. Each floorboard comprises a front face and a rear face extending in the horizontal plane HP, a core, a connecting means 8, 9, 10, 11, 15, 8', 54 arranged at least at two opposite edges for connecting a floorboard with a another floorboard 1' in a vertical and/or horizontal direction and a resilient surface layer 4. A moisture proof floorboard comprising, at an edge and in the resilient layer 4, a sealing means 51 configured to cooperate with another sealing means 52 in the resilient layer at an edge of another adjacent floorboard, to obtain a sealing.

Figure 5A:
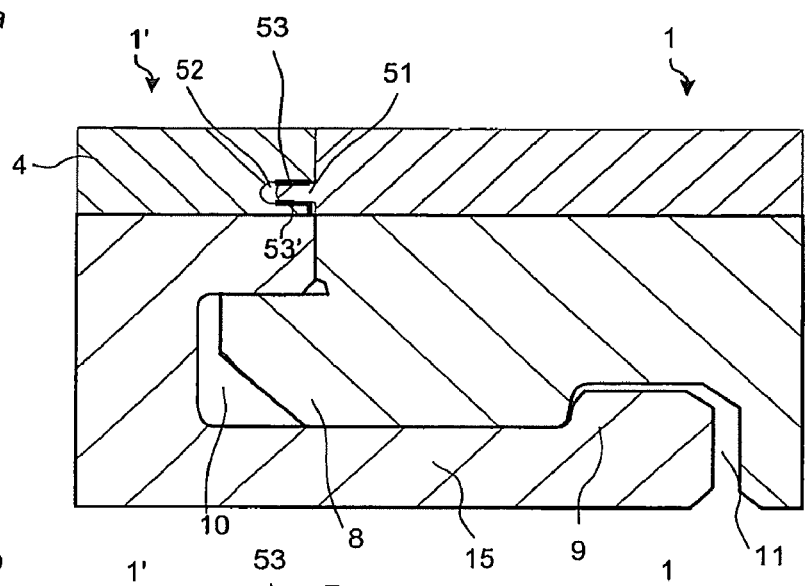
Figure 5B:
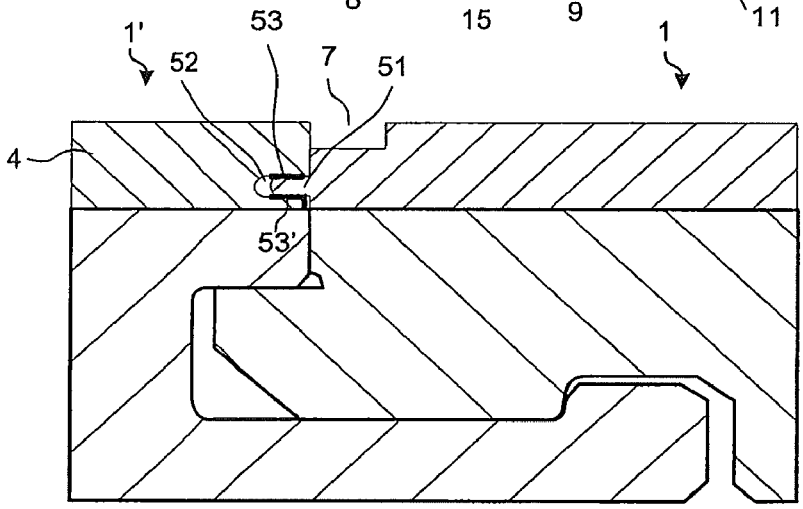
FIG. 5*b* shows an embodiment of a floorboard, according to the first aspect provided with a sealing means according to the second aspect.

The sealing means may comprise a horizontally extending protrusion and the other sealing means may comprise a sideways open groove, as shown in FIG. 5*a*. In the most preferred embodiment one or both of the sealing means are provided with a sealing agent 53.

Figure 6A:
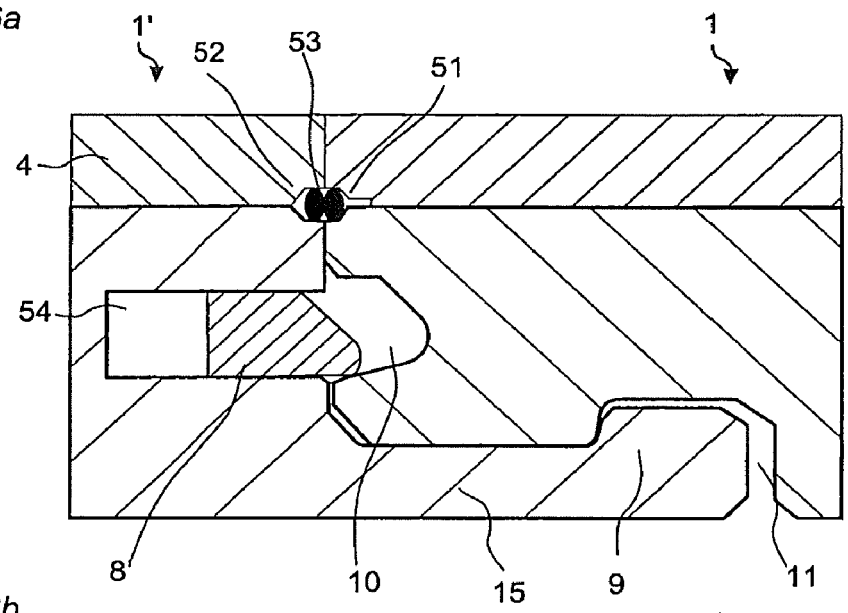

In another embodiment, shown in FIG. 6*a*, both the sealing means 51, 52 comprise a sideways open groove provided with a sealing agent 53.

Figure 5C:
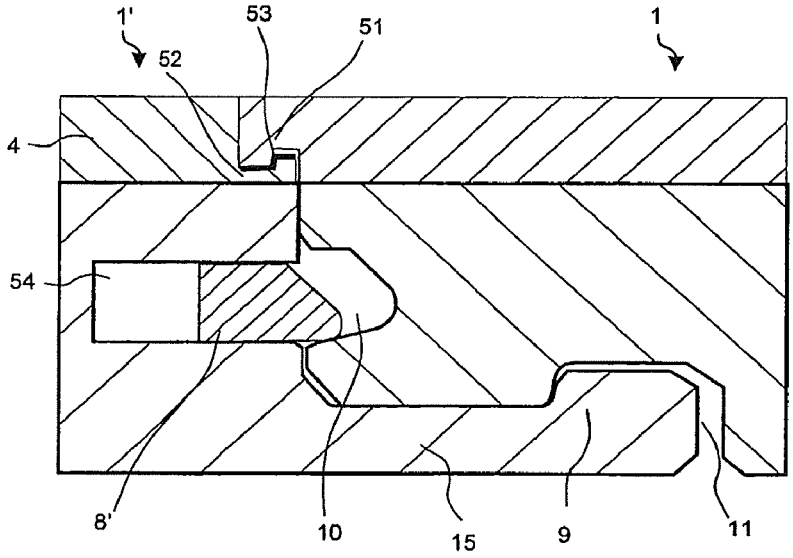

In FIG. 5*c* an embodiment of the sealing means is illustrated comprising overlapping edges, preferably provided with a hook shaped connection 51, 52. A sealing agent 53 may also be provided.

The sealing agent may comprise wax, grease, oil or bitumen. A preferred sealing agent comprises a mix of paraffin wax and paraffin oil. Another example is a micro wax and a natural or synthetic rubber strip.

Figure 6B:
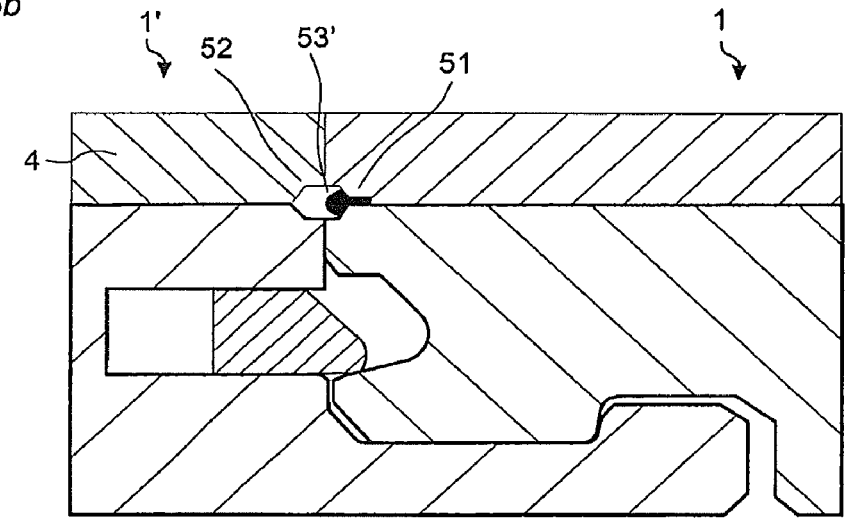
Figure 6C:
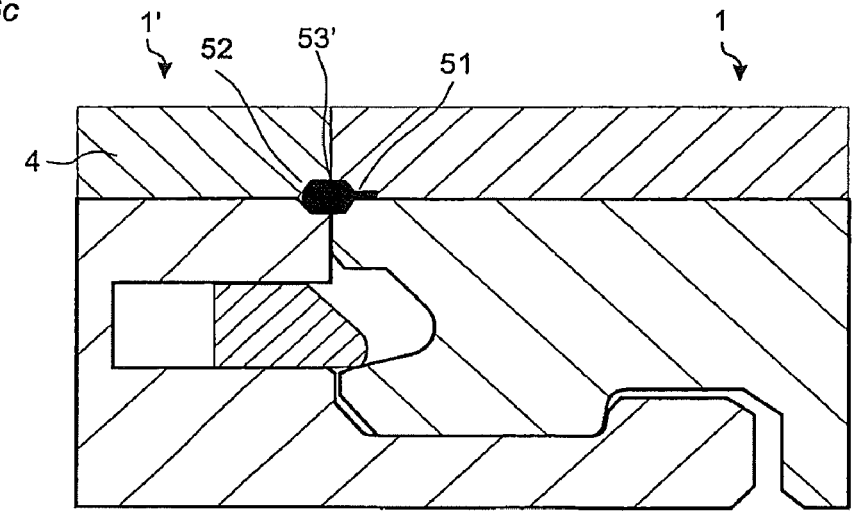

In FIG. 6*b* an embodiment of the sealing means is illustrated comprising an expandable sealing agent 53', arranged at a sideways open groove 51 in the resilient layer 4. The sealing agent is configured to expand into a sideways open groove 52 in the resilient layer of an adjacent floor panel, as illustrated in FIG. 6*c*, after that the two panels are connected to each other by the connecting means. An example of an expandable sealing agent 53' is a strip, preferably of polyurethane, provided with tape, which is removed just before the connection of the two adjacent floorboards. Other examples are materials, which expand when exposed to moisture.

The first aspect of the invention, comprising a decorative groove 7, may be combined with the second aspect, comprising sealing means 51, 52, as illustrated in 5*b*.

Figure 3:
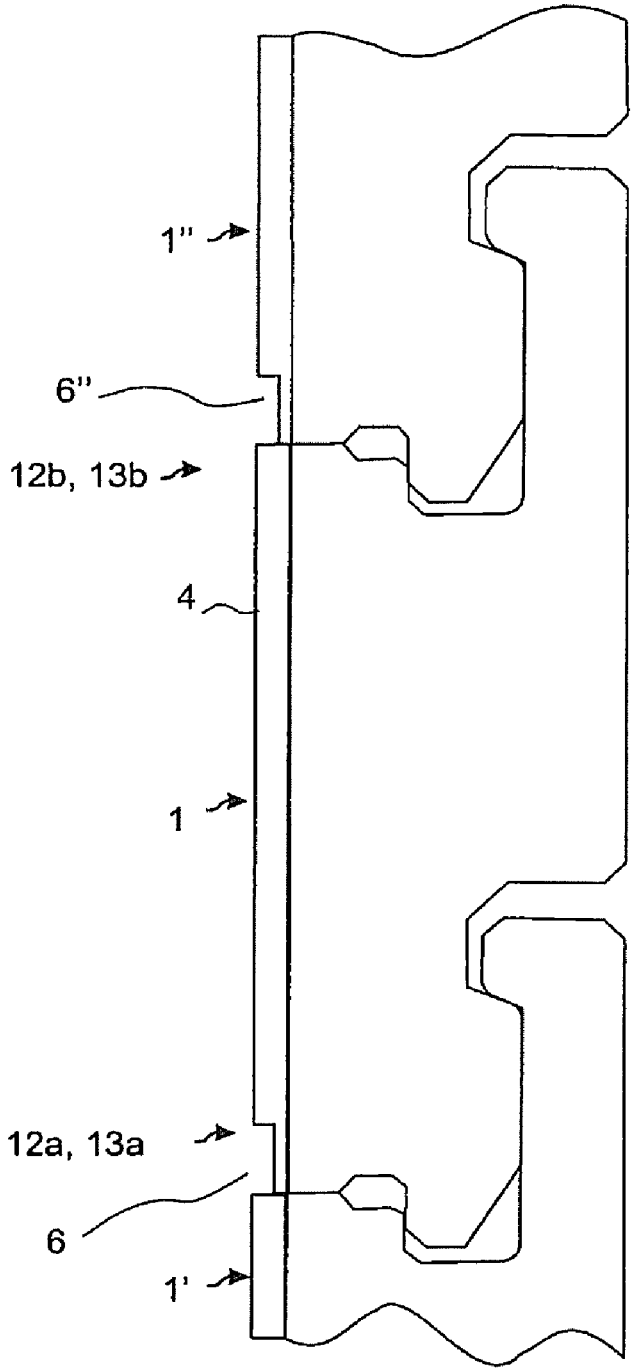
FIG. 3 shows three joined floorboards according to an embodiment of the invention.

A second object of the invention, represented by FIGS. 3 and 4, is a flooring comprising a set of the floorboards 1, 1', according to the first and/or second aspect, joined along adjacent edges, preferably mechanically.

In the most preferred embodiment, only one of the edges 12*a*, 13*a*, 12*b*, 13*b* of the two joined and adjacent edges is provided with the decorative groove.

Embodiments of the invention have mainly been described above with reference to a few embodiments. However, as is readily appreciated by a person skilled in the art, other embodiments than the ones disclosed above are equally possible within the scope of the invention, as defined by the appended patent claims.

Generally, all terms used in the claims are to be interpreted according to their ordinary meaning in the technical field, unless explicitly defined otherwise herein.

The invention claimed is:

1. A set of essentially identical moisture proof floorboards each comprising a front face and a rear face extending in the horizontal plane, a core, a connector arranged at least at two opposite edges for connecting a floorboard with another floorboard in a vertical and/or horizontal direction and a resilient surface layer, wherein the resilient surface layer at each of said opposite edges is provided with a sealing arrangement configured to cooperate with another sealing arrangement in the resilient layer at an edge of another floorboard, to obtain a sealing, one of the sealing arrangements is a horizontally extending protrusion and the other sealing arrangement is a sideways open groove, one or both of the sealing arrangements being provided with a sealing agent, wherein the horizontally extending protrusion has a top surface and a bottom surface, at least one of which is parallel to the front face of the floorboards, and the sideways open groove has a top surface and a bottom surface, a corresponding one of which is parallel to the front face of the floorboards.

2. The set of essentially identical moisture proof floorboards as claimed in claim 1, wherein the sealing agent comprises paraffin wax and/or paraffin oil.

3. The set of essentially identical moisture proof floorboards as claimed in claim 1, wherein the sealing agent is expandable.

4. The set of essentially identical moisture proof floorboards as claimed in claim 3, wherein the sealing agent is expandable in contact with water.

5. The set of essentially identical moisture proof floorboards as claimed in claim 1, wherein the floorboards comprise a core of a wood-based material.

6. The set of essentially identical moisture proof floorboards as claimed in claim 5, wherein the core comprises a material selected from HDF, MDF, particleboard or plywood.

7. The set of essentially identical moisture proof floorboards as claimed in claim 6, wherein the connector is a mechanical locking system.

8. The set of essentially identical moisture proof floorboards as claimed in claim 7, wherein the mechanical locking system is formed in the edge of the floorboard.

9. The set of essentially identical moisture proof floorboards as claimed in claim 1, wherein the resilient surface layer comprises a plastic material.

10. The set of essentially identical moisture proof floorboards as claimed in claim 9, wherein the plastic is PVC or polyethylene.

11. The set of essentially identical moisture proof floorboards as claimed in claim 10, wherein the resilient surface layer comprises a transparent wear layer of a moisture proof material.

12. The set of essentially identical moisture proof floorboards as claimed in claim 11, wherein the resilient surface layer comprises a decorative layer.

13. The set of essentially identical moisture proof floorboards as claimed in claim 12, wherein the decorative layer is a plastic film, a wood veneer, a cork layer or a print.

14. The set of essentially identical moisture proof floorboards as claimed in claim 12, wherein the resilient surface layer comprises a reinforcement layer closest to the core of the floorboard.

15. The set of essentially identical moisture proof floorboards as claimed in claim 1, wherein the resilient surface layer is substantially only one layer of a moisture proof material.

16. The set of essentially identical moisture proof floorboards as claimed in claim 11, wherein the moisture proof material is plastic or rubber.

17. The set of essentially identical moisture proof floorboards as claimed in claim 1, wherein the resilient surface layer is substantially only one layer plastic or rubber.

18. The set of essentially identical moisture proof floorboards as claimed in claim 1, wherein the resilient surface layer comprises a transparent wear layer, a decorative layer and an elastic reinforcement layer, wherein the sealing arrangements are in the elastic reinforcement layer.

19. The set of essentially identical moisture proof floorboards as claimed in claim 1, the sealing agent is provided on at least one of the top surface and the bottom surface of at least one of the horizontally extending protrusion and the sideways open groove.

20. The set of essentially identical moisture proof floorboards as claimed in claim 1, the sealing agent is provided on the top surface and the bottom surface of at least one of the horizontally extending protrusion and the sideways open groove.

21. The set of essentially identical moisture proof floorboards as claimed in claim 1, wherein the resilient surface layer is formed of only one layer of material.

* * * * *